United States Patent [19]

Nguyen et al.

[11] Patent Number: 4,956,068

[45] Date of Patent: Sep. 11, 1990

[54] NON-CONSUMABLE ANODE FOR MOLTEN SALT ELECTROLYSIS

[75] Inventors: Thinh Nguyen, Onex; Abdelkrim Lazouni, Geneva; Kim S. Doan, Onex, all of Switzerland

[73] Assignee: MOLTECH Invent S.A., Luxembourg

[21] Appl. No.: 350,477

[22] PCT Filed: Aug. 30, 1988

[86] PCT No.: PCT/EP88/00787

§ 371 Date: Apr. 28, 1989

§ 102(e) Date: Apr. 28, 1989

[87] PCT Pub. No.: WO89/01994

PCT Pub. Date: Mar. 9, 1989

[30] Foreign Application Priority Data

Sep. 2, 1987 [AT] Austria ..... 87810503

[51] Int. Cl.[5] ..... C25C 7/02

[52] U.S. Cl. ..... 204/242; 204/67; 204/290 R; 204/290 F; 204/291; 204/292; 204/293; 427/77; 427/123; 427/126.1; 427/126.2; 427/341; 427/337

[58] Field of Search ..... 204/67, 243 R, 290 R, 204/290 F, 291, 292, 293; 427/77, 123, 126.1, 126.2, 126.6, 341, 337

[56] References Cited

U.S. PATENT DOCUMENTS

| | | | |
|---|---|---|---|
| 2,548,514 | 4/1951 | Bramley | 427/77 |
| 4,024,294 | 5/1977 | Rairden, III | 427/42 |
| 4,157,943 | 6/1979 | Scarpellino, Jr. et al. | 204/290 R |
| 4,374,050 | 2/1983 | Ray | 252/519 |
| 4,374,761 | 2/1983 | Ray | 252/519 |
| 4,399,008 | 8/1983 | Ray | 204/67 |
| 4,478,693 | 10/1984 | Ray | 204/64 |
| 4,614,569 | 9/1986 | Duruz et al. | 204/67 |
| 4,620,905 | 11/1986 | Tarcy et al. | 204/64 |

FOREIGN PATENT DOCUMENTS

| | | |
|---|---|---|
| 0114085 | 7/1984 | European Pat. Off. . |
| 0257708 | 3/1988 | European Pat. Off. . |
| WO81/02027 | 7/1981 | World Int. Prop. O. . |

OTHER PUBLICATIONS

Chemical Abstracts, vol. 103, 1985, p. 226.

*Primary Examiner*—John F. Niebling
*Assistant Examiner*—Kathryn Gorgos
*Attorney, Agent, or Firm*—John J. Freer

[57] ABSTRACT

A non-consumable anode of the type comprising an oxide ceramic coating on a metal substrate, for molten salt electrolysis, namely the electrowinning of metals such as aluminum, has an electronically-conductive oxygen barrier layer between the oxide ceramic coating and the substrate, the oxygen barrier layer containing chromium oxide. Usually, the oxygen barrier layer is a surface film integral with a chromium-containing alloy substrate, comprising 10 to 30% by weight of chromium, 55 to 90% of nickel, cobalt and/or iron and up to 15% of aluminum, titanium, zirconium, yttrium, hafnium or niobium. The ceramic oxide coating may comprise copper oxide in solid solution with at least one further oxide; nickel ferrite; copper oxide and nickel ferrite; doped, non-stoichiometric or partially substituted spinels; or rare earth metal oxides or oxyfluorides.

12 Claims, No Drawings

NON-CONSUMABLE ANODE FOR MOLTEN SALT ELECTROLYSIS

FIELD OF INVENTION

The invention relates to non-consumable anodes of the type comprising an oxide ceramic coating on a metal, alloy or cermet substrate, for molten salt electrolysis namely the electrowinning of metals such as aluminum. The invention also relates to methods of manufacturing such anodes as well as molten salt electrolysis cells incorporating them and methods of electrowinning metal from molten salts using such anodes.

BACKGROUND OF INVENTION

Materials used as non-consumable anodes in molten electrolytes must have a good stability in an oxidizing atmosphere, good mechanical properties, good electrical conductivity and be able to operate for prolonged periods of time under polarizing conditions. At the same time, the welding and machining of large components should not present unsurmountable problems to the practitioner. It is well known that ceramic materials have good chemical corrosion properties. However, their low electrical conductivity and difficulties of making mechanical and electrical contact as well as difficulties in shaping and machining these materials seriously limit their use.

U.S. Pat. No. 4,374,050 discloses inert electrodes for aluminum production fabricated from at least two metals or metal compounds to provide a combination metal compound. For example, an alloy of two or more metals can be surface oxidized to form a compounded oxide of the metals at the surface on an unoxidized alloy substrate. U.S. Pat. No. 4,374,761 discloses similar compositions further comprising a dispersed metal powder in an attempt to improve conductivity. U.S. Pat. Nos. 4,399,008 and 4,478,693 provide similar combinations of metal oxide compositions which may be applied as a preformed oxide composition on a metal substrate by cladding or plasma spraying. Such application techniques, however, are known to involve many drawbacks and the adhesion is particularly poor. U.S. Pat. No. 4,620,905 describes an oxidized alloy electrode based on tin or copper with nickel, iron, silver, zinc, magnesium, aluminum and yttrium, either as a cermet or partially oxidized at its surface. Such partially oxidized alloys suffer serious disadvantages in that the oxide layers formed are far too porous to oxygen, and not sufficently stable in corrosive environments. In addition, it has been observed that at high temperatures the partially oxidized structures continue to oxidize, and this uncontrolled oxidation causes subsequent segregation of the metal and/or oxide layer. In addition, the machining of ceramics and achieving a good mechanical and electrical contact with such materials involves problems which are difficult to solve. Adherence at the ceramic-metal interfaces is particularly difficult to achieve, and this very problem has hampered use of such simple composites. Finally, all these materials as such have not proven satisfactory as substrates for cerium oxyfluoride coatings of the type discussed below.

U.S. Pat. No. 4 614 569 describes a method of electrowinning metals by electrolysis of a melt containing a dissolved species of the metal to be won using an anode immersed in the melt wherein the anode has a metal, alloy or cermet substrate and an operative anode surface which is a protective surface coating containing a compound of a metal less noble than the metal to be electrowon; the protective coating being preserved by maintaining in the melt a suitable concentration of a species of this less noble metal. Usually, the protective anode coating comprises a fluorine-containing oxycompound of cerium (referred to as "cerium oxyfluoride") alone or in combination with additives such as compounds of tantalum, niobium, yttrium, lanthanum, praesodymium and other rare earth elements; this coating being maintained by the addition of cerium and possibly other elements to the electrolyte. The electrolyte can be molten cryolite containing dissolved alumina, i.e. for the production of aluminum.

This electrowinning method potentially has very significant advantages. To date, however, there remain problems with the anode substrate. When this is a ceramic, the conductivity may be low when the substrate is a metal, alloy or cermet, it may be subject to oxidation leading to a reduced life of the anode, despite the excellent protective effect of the cerium oxyfluoride coating which protects the substrate from direct attack by the corrosive electrolyte.

A promising solution to these problems has been the use of a ceramic/metal composite material of at least one ceramic phase and at least one metallic phase, comprising mixed oxides of cerium with aluminum, nickel, iron and/or copper in the form of a skeleton of interconnected ceramic oxide grains which skeleton is interwoven with a continuous metallic network of an alloy or intermetallic compound of cerium with aluminum, nickel, iron and/or copper, as described in EP-A-0 257 708. When used as electrode substrates, these materials have promise, particularly those based on cerium and aluminum because even if they corrode, this does not lead to corrosion products that contaminate the electrowon aluminum. Nevertheless corrosion of the substrate remains a problem.

DISCLOSURE OF THE INVENTION

It is an object of the present invention to provide an improved non-consumable anode for electrowinning aluminum and other metals from molten salts containing compounds (e.g. oxides) of the metals to be won, made from a ceramic/metal composite comprising a metal, alloy or cermet substrate with a surface ceramic coating.

It is a further object of the invention to provide an improved electrochemical cell for electrowinning aluminum and other metals from their oxides with one or more anodes made from the ceramic/metal composite comprising a metal, alloy or cermet substrate with a surface ceramic coating.

Still another object of the invention is to provide a method of manufacturing ceramic/metal composite anode structures having a good chemical stability at high temperatures in oxidizing and/or corrosive environments; a good electrochemical stability at high temperatures under anodic polarization conditions; a low electrical resistance; a good chemical compatibility and adherence between the ceramic and metal parts; a good machinability; a low cost of materials and manufacture; and a facility of scaling up to industrial scale.

According to the invention, there is provided an anode for metal electrowinning from molten salt electrolytes, comprising an oxide ceramic coating on a metal, alloy or cermet substrate, characterized by an electronically-conductive oxygen barrier layer between the oxide ceramic coating and the substrate, the oxygen barrier layer containing chromium oxide.

In one method of manufacturing the non-consumable anode according to the invention, the oxygen barrier layer containing chromium oxide is produced by (a) providing on the metal substrate a surface layer containing chromium metal and/or chromium oxide; (b) applying to said surface layer the oxide ceramic coating or a precursor of the oxide ceramic coating; and (c) usually heating in an oxidizing atmosphere to convert chromium metal in said surface layer to chromium oxide and/or to convert the ceramic oxide precursor into the ceramic oxide coating. More specifically, the method of manufacture may comprise in-situ oxidation of a surface layer of the metal substrate containing chromium metal by heating in an oxidizing atmosphere after application to said surface layer of the oxide ceramic coating or a precursor of the oxide ceramic coating.

Further objects and advantages of the invention are set out in the following description and in the appended claims.

The composite structure of the invention typically has a metallic core of a high temperature resistant alloy for example chromium with nickel, cobalt or iron and optional components, with a a ceramic coating which may be an oxidized copper alloy. In addition to 55–90% by weight of the basic component nickel, cobalt and/or iron, the core alloy contains 10 to 30% by weight of chromium, but is essentially devoid of copper or comparable metals which oxidize easily, i.e. contains no more than 1% by weight of such components, usually 0.5% or less. Other minor components such as aluminum, hafnium, molybdenum, niobium, silicon, tantalum, titanium, tungsten, vanadium, yttrium and zirconium can be added into the core alloy up to a total content of 15% by weight in order to improve its oxidation resistance at high temperatures. Other elements, such as carbon and boron, may also be present in trace quantities, usually well less than 0.5%. Commercially available so-called superalloys or refractory alloys such as INCONEL TM HASTALLOY TM, HAYNES TM, UDIMET TM, NIMONIC TM, INCOLOY TM, as well as many variants thereof may conveniently be used for the core.

In some embodiments, the surface ceramic coating comprises an oxidized alloy of 15 to 75% by weight copper, 25 to 85% by weight of nickel and/or manganese, up to 5% by weight of lithium, calcium, aluminum, magnesium or iron and up to 30% by weight of platinum, gold and/or palladium in which the copper is fully oxidized and at least part of the nickel and/or manganese is oxidized in solid solution with the copper oxide, and the substrate comprises 15–30% by weight of chromium, 55–85% of nickel, cobalt and/or iron (for example 70–80% of nickel with 6–10% iron, or 75–85% iron) and up to 15% by weight of aluminum, hafnium, molybdenum, niobium, silicon, tantalum, titanium, tungsten, vanadium, yttrium or zirconium, the interface of the substrate with the surface ceramic coating having an oxygen-barrier layer comprising chromium oxide.

The metallic coating or envelope may be made of a copper based alloy and is typically 0.1 to 2 mm thick. The copper alloy typically contains 20 to 60% by weight of copper and 40–80% by weight of another component of which at least 15–20% forms a solid solution with copper oxide. Cu-Ni or Cu-Mn alloys are typical examples of this class of alloys. Some commercial Cu-Ni alloys such as varieties of MONEL TM or CONSTANTAN TM may be used.

Further embodiments of the surface ceramic coating include nickel ferrite; copper oxide and nickel ferrite; doped, non-stoichiometric and partially substituted ceramic oxide spinels containing combinations of divalent nickel, cobalt, magnesium, manganese, copper and zinc with divalent/trivalent nickel, cobalt, manganese and/or iron, and optionally dopants selected from $Ti^{4+}$, $Zr^{4+}$, $Sn^{4+}$, $Fe^{4+}$, $Hf^{4+}$, $Mn^{4+}$, $Fe^{3+}$, $Ni^{3+}$, $Co^{3+}$, $Mn^{3+}$, $Al^{3+}$, $Fe^{2+}$, $Ni^{2+}$, $Co^{2+}$, $Mg^{2+}$, $Mn^{2+}$, $Cu^{2+}$, $Zn^{2+}$ and $Li^{+}$ (see U.S. Pat. No. 4 552 630); as well as coatings based on rare earth oxides and oxyfluorides, in particular cerium oxyfluoride alone or in combination with other components.

The alloy core resists oxidizing in oxidizing conditions at temperatures up to 1100° C. by the formation of an oxygen impermeable refractory oxide layer at the interface. This oxygen-impermeable electronically-conductive layer is advantageously obtained by in-situ oxidation of chromium contained in the alloy forming a thin film of chromium oxide, or a mixed oxide of chromium and other minor components of the alloys.

Alternatively, a chromium oxide barrier layer could be applied e.g. by plasma spraying on to a nickel, cobalt or iron-based alloy base, or other types of essentially oxygen-impermeable electronically conductive barrier layers could be provided, such as platinum/zirconium layer or a nickel-aluminum layer, mixed-oxide layers especially based on chromium oxide, alloys and intermetallics especially those containing platinum or another precious metal, or non-oxide ceramics such as carbides. Preferably, however, barrier layers containing chromium oxide, alone or with another oxide, will be formed by in-situ oxidation of a suitable alloy, substrate, but, especially for other compositions, different methods are also available including torch spraying, plasma spraying, cathodic sputtering, electron beam evaporation and electroplating followed, as appropriate, by an oxidizing treatment before or after the coating is applied as a metal, layers of different metals or as an alloy.

The metallic composite structure may be of any suitable geometry and form. Shapes of the structure may be produced by machining, extrusion, cladding or welding. For the welding process, the supplied metal must have the same composition as the core or of the envelope alloys. In another method of fabricating the metallic composite structures, the envelope alloy is deposited as a coating onto a machined alloy core. Such coatings may be applied by well-known deposition techniques: torch spraying, plasma spraying, cathodic sputtering, electron beam evaporation or electroplating. The envelope alloy coating may be deposited directly as the desired composition, or may be formed by post diffusion of different layers of successively deposited components.

After the shaping step, the composite structures are usually submitted to a controlled oxidation in order to transform the alloy of the envelope into a ceramic envelope. The oxidation step is carried out at a temperature lower than the melting point of the alloys. The oxidation temperature may be chosen such that the oxidation rate is about 0.005 to 0.010 mm per hour. The oxidation may be conducted in air or in controlled oxygen atmosphere, preferably at about 1000° C. for 10–24 hours to fully oxidize the copper.

It has been observed that a substrate component, in particular iron, or generally any component metal present in the substrate alloy but not present in the coating alloy, may diffuse into the ceramic oxide coating during the oxidation phase before oxidation is completed, or diffusion may be induced by heating in an inert atmosphere prior to oxidation. Diffusion of a coating component into the substrate can also take place. Preferably, after the oxidation step the composite is heated in air at about 1000° C. for about 100 to 200 hours. This annealing or ageing step improves the uniformity of the composition and the structure of the formed ceramic phase, preferably at about 1000° C. for 10–24 hours to fully oxidize the copper.

The ceramic phase may advantageously be a solid solution of $(M_xCu_{1-x})\ O_y$, M being at least one of the principal components of the envelope alloy. Because of the presence of the copper oxide matrix which plays the role of oxygen transfer agent and binder during the oxidation step, the envelope alloy can be transformed totally into a coherent ceramic phase. The stresses which usually occur due to the volume increase during the transformation of the envelope alloy are absorbed by the plasticity of the copper oxide phase which reduces the risks of cracking of the ceramic layer. When the envelope alloy is completely transformed into a ceramic phase, the surface of the refractory alloy of the core of the structure reacts with oxygen, and forms a $Cr_2O_3$-based oxide layer which plays the role of oxygen barrier impeding further oxidation of the core. Because of the similar chemical stabilities of the constituents of the ceramic phase formed from the copper based alloy and the chromium oxide phase of the core, there is no incompatibility between the ceramic envelope and the metallic core, even at high temperatures. The limited interdiffusion between the chromium oxide based layer at the metallic core surface, and the copper oxide based or other ceramic envelope may confer to the latter a good adherence on the metallic core.

The presence of CuO confers to the ceramic envelope layer the characteristics of a semi-conductor. The electrical resistivity of CuO is about $10^{-2}$ to $10^{-1}$ ohm cm at 1000° C., and this is reduced by a factor of about 100 by the presence of a second metal oxide such as NiO or $MnO_2$. The electrical conductivity of this ceramic phase may be further improved by incorporating a soluble noble metal into the copper alloy before the oxidation step. The soluble noble metals may be for example palladium, gold or platinum in an amount of up to 20–30% by weight. In such a case, a cermet envelope may be obtained, with a noble metal network uniformly distributed in the ceramic matrix. Another way to improve the electrical conductivity of the ceramic envelope may be the introduction of a dopant of the second metal oxide phase; for example, the NiO of the ceramic phase prepared from Ni-Cu alloys may be doped by lithium.

By formation of a solid solution with stable oxides such as NiO or $MnO_2$, the copper oxide based ceramic envelope has a good stability under corrosive conditions at high temperatures. Furthermore, after the ageing step, the composition of the ceramic phase may be more uniform, with large grain sizes, whereby the risk of grain boundary corrosion is strongly decreased.

The non-consumable anodes according to this invention can be used in molten salt electrolysis at temperatures in the range between 400°–1000° C. as a completely prefabricated anode or as an anode substrate for anode coatings based on cerium oxyfluoride used in aluminum electrowinning.

The application of the anodes as substrate for cerium oxyfluoride coatings is particularly advantageous because the cerium oxyfluoride coating can interpenetrate with the copper-oxide based or other ceramic coating providing excellent adhesion. In addition, formation of the cerium oxyfluoride coating on the material according to the invention in situ from molten cryolite containing cerium species takes place with no or minimal corrosion of the substrate, and a high quality adherent deposit is obtained.

For this application as the anode substrate, it is understood that the metal being electrowon will necessarily be more noble than the cerium ($Ce^{3+}$) dissolved in the melt, so that the desired metal deposits at the cathode with no substantial cathodic deposition of cerium. Such metals can preferably be chosen from group IIIa (aluminum, gallium, indium, thallium), group IVb (titanium, zirconium, hafnium), group Vb (vanadium, niobium, tantalum) and group VIIb (manganese, rhenium).

The protective coating of eg cerium oxyfluoride may be electrodeposited on the anode substrate during an initial operating period in the molten electrolyte in the electrowinning cell, or the protective coating may be applied to the anode substrate prior to inserting the anode in the molten electrolyte in the cell. Preferably, electrolysis is carried out in a fluoride-based melt containing a dissolved oxide of the metal to be won and at least one cerium compound; the protective coating being predominantly a fluorine-containing cerium oxycompound. For example, the coating may consist essentially of fluorine-containing ceric oxide with only traces of additives.

Advantages of the invention over the prior art will now be demonstrated by the following examples.

EXAMPLE 1

Oxidation of a copper - based alloy

A tube of Monel 400 TM alloy (63% Ni - 2% Fe - 2.5% Mn - balance Cu) of 10 mm diameter, 50 mm length, with a wall thickness of 1 mm, is introduced in a furnace heated at 1000° C., in air. After 400 hours of oxidation, the tube is totally transformed into a ceramic structure of about 12 mm diameter and 52 mm length, with a wall thickness of 1.25 mm. Under optical microscope, the resulting ceramic presents a monophase structure, with large grain sizes of about 200–500 micrometers. Copper and nickel mappings, made by Scanning Electron Microscopy, show a very uniform distribution of these two components; no segregation of composition at the grain boundaries is observed. Electrical conductivity measurements of a sample of the resulting ceramic show the following results:

| TEMPERATURE (°C.) | RESISTIVITY (Ohm.cm) |
|---|---|
| 400 | 8.30 |
| 700 | 3.10 |
| 850 | 0.42 |
| 925 | 0.12 |
| 1000 | 0.08 |

EXAMPLE 2

Annealing of an oxidized copper - based alloy

Two tubes of Monel 400 TM oxidized at 1000° C. in air as described in Example 1 are subjected to further annealing in air at 1000° C. After 65 hours, one tube is removed from the furnace, cooled to room temperature, and the cross section is examined by optical microscope. The total thickness of the tube wall is already oxidized, and transformed into a monophase ceramic structure, but the grain joints are rather loose, and a copper rich phase is observed at the grain boundaries. After 250 hours, the second tube sample is removed from the furnace and cooled to room temperature. The cross section is observed by optical microscope. Increasing the ageing step from 65 hours to 250 hours produces an improved, denser structure of the ceramic phase. No visible grain boundary composition zone is observed.

Examples 1 and 2 thus show that these copper-based alloys, when oxidized and annealed, display interesting characteristics. However, as will be demonstrated by testing (Example 5) these alloys alone are inadequate for use as an electrode substrate in aluminum production.

EXAMPLES 3a, 3b and 3c

Production of composites according to the invention

EXAMPLE 3a

A tube with a semi-spherical end, of 10 mm outer diameter and 50 mm of length, is machined from a bar of Monel 400 TM. The tube wall thickness is 1 mm. A bar of Inconel TM (type 600: 76% Ni - 15.5% Cr - 8% Fe) of 8 mm diameter and 500 mm length is inserted mechanically in the Monel tube. The exposed part of the Inconel bar above the Monel envelope is protected by an alumina sleeve. The structure is placed in a furnace and heated, in air, from room temperature to 1000° C. during 5 hours. The furnace temperature is kept constant at 1000° C. during 250 hours; then the furnace is cooled to room temperature at a rate of about 50° C. per hour. Optical microscope examination of the cross section of the final structure shows a good interface between the Inconel core and the formed ceramic envelope. Some microcracks are observed at the interface zone of the ceramic phase, but no cracks are formed in the outer zones. The Inconel core surfaces are partially oxidized to a depth of about 60 to 75 micron. The chromium oxide based layer formed at the Inconel surface layer interpenetrates the oxidized Monel ceramic phase and insures a good adherence between the metallic core and the ceramic envelope.

EXAMPLE 3b

A cylindrical structure with a semi-spherical end, of 32 mm diameter and 100 mm length, is machined from a rod of Inconel-600 TM (Typical composition: 76% Ni - 15.5% Cr - 8% Fe + minor components (maximum %): carbon (0.15%), Manganese (1%), Sulfur (0.015%), Silicon (0.5%), Copper (0.5%)). The surface of the Inconel structure is then sand blasted and cleaned successively in a hot alkali solution and in acetone in order to remove traces of oxides and greases. After the cleaning step, the structure is coated successively with a layer of 80 micrometers of nickel and 20 micrometers of copper, by electrodeposition from nickel sulfamate and copper sulfate baths respectively. The coated structure is heated in an inert atmosphere (argon containing 7% hydrogen) at 500° C. for 10 hours, then the temperature is increased successively to 1000° C. for 24 hours and 1100° C. for 48 hours. The heating rate is controlled at 300° C./hour. After the thermal diffusion step, the structure is allowed to cool to room temperature. The interdiffusion between the nickel and copper layers in complete, and the Inconel structure is covered by an envelope coating of Ni-Cu alloy of about 100 micrometers. Analysis of the resulting envelope coating gave the following values for the principal components:

| | Coating Surface | Coating-Substrate interdiffusion zone |
|---|---|---|
| Ni (w %) | 71.8 | 82.8–81.2 |
| Cu (w %) | 26.5 | 11.5–0.7 |
| Cr (w %) | 1.0 | 3.6–12.0 |
| Fe (w %) | 0.7 | 2.1–6.1 |

After the diffusion step, the coated Inconel structure is oxidized in air at 1000° C. during 24 hours. The heating and cooling rates of the oxidation step are respectively 300° C./hour and 100° C./hour. After the oxidation step, the Ni-Cu envelope coating is transformed into a black, uniform ceramic coating with an excellent adherence on the Inconel core. Examination of a cross-section of the final structure shows a monophase nickel/-copper oxide outer coating of about 120 micrometers and an inner layer of $Cr_2O_3$ of 5 to 10 micrometers. The inside of the Inconel core remained in the initial metallic state without any trace of internal oxidation.

EXAMPLE 3c

A cylindrical structure with a semi-spherical end, of 16 mm diameter and 50 mm length, is machined from a rod of ferritic stainless steel (Typical composition: 17% Cr, 0.05% C, 82.5% Fe). The structure is successively coated with 160 micrometers Ni and 40 micrometers Cu as described in Example 3b, followed by a diffusion step in an Argon-7% Hydrogen atmosphere at 500° C. for 10 hours, at 1000° C. for 24 hours and 1100° C. for 24 hours. Analysis of the resulting envelope coating gave the following values for the principal components:

| | Coating surface | Coating-Substrate interdiffusion zone |
|---|---|---|
| Ni (w %) | 61.0 | 39.4–2.1 |
| Cu (w %) | 29.8 | 0.2–0 |
| Cr (w %) | 1.7 | 9.2–16.0 |
| Fe (w %) | 7.5 | 51.2–81.9 |

After the diffusion step, the ferritic stainless steel structure and the final coating is oxidized in air, at 1000° C. during 24 hours as described in Example 3b. After the oxidation step, the envelope coating is transformed into a black, uniform ceramic coating. A cross section of the final structure shows a multi-layer ceramic coatings composed of:

- an uniform nickel/copper oxide outer coating of about 150 micrometers, which contains small precipitates of nickel/iron oxide;
- an intermediate nickel/iron oxide coating of about 50 micrometer, which is identified as a $NiFe_2O_4$ phase; and
- a composite metal-oxide layer of 25 to 50 micrometers followed by a continuous $Cr_2O_3$ layer of 2 to 5 micrometers.

The inside of the ferritic stainless steel core remained in the initial metallic state.

EXAMPLE 4

Testing of a composite according to the invention

A composite ceramic-metal structure prepared from a Monel 400-Inconel 600 structure, as described in Example 3a, is used as the anode in an aluminum electrowinning test, using an alumina crucible as the electrolysis cell and a titanium diboride disk as cathode. The electrolyte is composed of a mixture of cryolite ($Na_3AlF_6$) with 10% $Al_2O_3$ and 1% $CeF_3$ added. The operating temperature is maintained at 970–980° C., and a constant anodic current density of 0.4 A/cm$^2$ is applied. After 60 hours of electrolysis, the anode is removed from the cell for analysis. The immersed anode surface is uniformly covered by a blue coating of cerium oxyfluoride formed during the electrolysis. No apparent corrosion of the oxidized Monel ceramic envelope is observed, even at the melt line non-covered by the coating. The cross section of the anode shows successively the Inconel core, the ceramic envelope and a cerium oxyfluoride coating layer about 15 mm thick Because of interpenetration at the interfaces of the metal/ceramic and ceramic/coating, the adherence between the layers is excellent. The chemical and electrochemical stability of the anode is proven by the low levels of nickel and copper contaminations in the aluminum formed at the cathode, which are respectively 200 and 1000 ppm. These values are considerably lower than those obtained in comparable testing with a ceramic substrate, as demonstrated by comparative Example 5.

EXAMPLE 5

Comparative testing of oxidized/annealed copper based alloy

The ceramic tube formed by the oxidation/annealing of Monel 400 TM in Example 2 is afterwards used as an anode in an aluminum electrowinning test following the same procedure as in Example 4. After 24 hours of electrolysis, the anode is removed from the cell for analysis. A blue coating of oxyfluoride is partially formed on the ceramic tube, occupying about 1 cm of the immediate length below the melt line. No coating, but a corrosion of the ceramic substrate, is observed at the lower parts of the anode. The contamination of the aluminum formed at the cathode was not measured; however, it is estimated that this contamination is about 10–50 times the value reported in Example 4. This poor result is explained by the low electrical conductivity of the ceramic tube. In the absence of the metallic core, only a limited part of the tube below the melt line is polarized with formation of the coating. The lower immersed parts of the anode, non polarized, are exposed to chemical attack by cryolite. The tested material alone is thus not adequate as the anode substrate for a cerium oxyfluoride based coating. It is, hence, established that the composite material according to the invention (i.e. the material of Example 3a as tested in Example 4) is technically greatly superior to the simple oxidized/annealed copper oxidized based alloy.

EXAMPLE 6

Testing of a composite material according to the invention

Two cylindrical structures of Inconel-600 TM are machined as described in Example 3b and coated with a nickel-copper alloy layer of 250–300 micrometers by flame spraying a 70w% Ni - 30w% Cu alloy powder. After the coating step, the structures are connected parallel to two ferritic steel conductor bars of an anode support system. The conductor bars are protected by alumina sleeves. The coated Inconel anodes are then oxidized at 1000° C. in air. After 24 hours of oxidation the anodes are transfered immediately to an aluminum electrowinning cell made of a graphite crucible. The crucible has vertical walls masked by an alumina ring, and the bottom is polarized cathodically. The electrolyte is composed of a mixture of cryolite ($Na_3AlF_6$) with 8.3% $AlF_3$, 8.0% $Al_2O_3$ and 1.4% $CeO_2$ added. The operating temperature is maintained at 970°–980° C. The total immersion height of the two nickel/copper oxide coated Inconel electrodes is 45 mm from the semi-spherical bottom. The electrodes are then polarized anodically with a total current of 22.5A during 8 hours. Afterwards, the total current is progressively increased up to 35A and maintained constant for 100 hours. During this second period of electrolysis, the cell voltage is in the range of 3.95 to 4.00 volts. After 100 hours of operation at 35A, the two anodes are removed from the cell for examination. The immersed anode surfaces are uniformly covered by a blue coating of cerium oxyfluoride formed during the first electrolysis period. The black ceramic nickel/copper oxide coating of the non-immersed parts of the anode is covered by a crust formed by condensation of cryolite vapors over the liquid level. Examination of cross-sections of the anodes show successively:

- an outer cerium oxyfluoride coating of about 1.5 mm thickness;
- an intermediate nickel/copper oxide coating of 300–400 micrometers; and
- an inner $Cr_2O_3$ layer of 5 to 10 micrometers.

No sign of oxidation or degradation of the Inconel core is observed, except for some microscopic holes resulting from the preferential diffusion of chromium to the Inconel surface, forming the oxygen barrier $Cr_{23}$ (Kirkendall porosity).

We claim:

1. An anode for electrowinning aluminum from molten salt electrolytes, and which, in use, is a substrate for a coating formed or maintained in-situ in the molten electrolyte, the anode comprising an oxide ceramic coating applied on a metal, alloy or cermet substrate, and an electronically-conductive oxygen barrier layer between the oxide ceramic coating and the substrate, the oxygen barrier layer containing chromium oxide, and the oxide ceramic coating which swerves as anchorage for said in-situ coating comprising copper oxide in solid solution with at least one further oxide; nickel ferrite; copper oxide and nickel ferrite; or doped, non-stoichiometric or partially substituted spinel.

2. The anode of claim 1, in which the oxygen barrier layer is a surface film integral with a chromium-containing alloy substrate.

3. The anode of claim 2, in which the substrate is an alloy comprising 10 to 30% by weight of chromium, 55 to 90% of one or more of nickel, cobalt or iron and up to 15% of aluminum, titanium, zirconium, yttrium, hafnium or niobium.

4. The anode of claim 1, in which the oxygen barrier layer is a separate layer of chromium oxide applied to the surface of the metal, alloy or cermet substrate.

5. The anode of claim 1, in which the oxide ceramic coating contains an oxidized metal which is present in the substrate, in combination with an oxidized metal which is not present in the substrate.

6. The anode of claim 1, in which the oxide ceramic coating comprises copper oxide in solid solution with an oxide of nickel or an oxide of manganese.

7. The anode of claim 1, in which the oxide ceramic coating further contains at least one non-oxidized precious metal in an amount of up to 30% by weight of the coating.

8. A method of manufacturing the anode of claim 1 comprising:

(a) providing on the metal, alloy or cermet substrate a surface layer containing one or more of chromium metal or chromium oxide;

(b) applying to said surface layer the oxide ceramic coating, or a precursor of the oxide ceramic coating of claim 1; and (c) heating the resulting anode in an oxidizing atmosphere when needed to convert chromium metal in said surface layer to chromium oxide or the convert the ceramic oxide precursor into the ceramic oxide coating, or to convert both.

9. The method of claim 8, in which the oxygen barrier layer containing chromium oxide is produced by in-situ oxidation of a surface layer of a metal, alloy or cermet substrate containing chromium metal by heating in an oxidizing atmosphere after application to said surface layer of the oxide ceramic coating or a precursor of the oxide ceramic coating.

10. The method of claim 8, in which a protective layer of cerium oxyfluoride is applied to the oxide ceramic coating by polarizing the anode in a molten electrolyte containing a cerium species.

11. A method of electrowinning aluminum from molten salt electrolytes using the anode of claim 1.

12. A cell for electrowinning a metal from a molten salt electrolyte, comprising at least one anode as claimed in claim 1.

* * * * *